US009297243B2

(12) United States Patent
Zhang et al.

(10) Patent No.: US 9,297,243 B2
(45) Date of Patent: Mar. 29, 2016

(54) COMPOSITE PERFORATION METHOD AND DEVICE WITH PROPPING AGENT

(71) Applicant: TONG OIL TOOLS CO., LTD., Xi'an (CN)

(72) Inventors: Guoan Zhang, Xi'an (CN); Jianlong Cheng, Xi'an (CN)

(73) Assignee: TONG OIL TOOLS CO., LTD, Xi'an (CN)

( * ) Notice: Subject to any disclaimer, the term of this patent is extended or adjusted under 35 U.S.C. 154(b) by 453 days.

(21) Appl. No.: 13/759,060

(22) Filed: Feb. 5, 2013

(65) Prior Publication Data

US 2013/0146287 A1 Jun. 13, 2013

Related U.S. Application Data

(63) Continuation-in-part of application No. PCT/CN2011/083113, filed on Nov. 29, 2011.

(30) Foreign Application Priority Data

Dec. 29, 2010 (CN) ..... 2010 1 0609790

(51) Int. Cl.
*E21B 43/11* (2006.01)
*E21B 43/267* (2006.01)
*E21B 43/116* (2006.01)

(52) U.S. Cl.
CPC ..... *E21B 43/267* (2013.01); *E21B 43/11* (2013.01); *E21B 43/116* (2013.01)

(58) Field of Classification Search
USPC ..... 166/297, 55
See application file for complete search history.

(56) References Cited

U.S. PATENT DOCUMENTS 2,837,995 A 6/1958 Castel
2,980,017 A 4/1961 Castel
3,620,314 A 11/1971 Bohn (Continued)

FOREIGN PATENT DOCUMENTS

CN 2270115 12/1997
CN 2309419 3/1999

(Continued)

OTHER PUBLICATIONS

Sep. 15, 2011 Office Action for CN 200910218911.0.

(Continued)

*Primary Examiner* — Taras P Bemko
(74) *Attorney, Agent, or Firm* — Law Offices of Albert Wai-Kit Chan, PLLC

(57) ABSTRACT

The present invention provides composite perforation methods and device with propping agent capable of effectively propping the fractures in the oil layer, thereby reducing the closure of fractures and prolonging the oil extraction cycle. The device comprises one or more connected perforators wherein each of said perforator comprises one or more perforating charges and a propping agent unit 7 at the open end of each of said perforating charge, a pressure release hole 9 located directly behind the jet flow of said perforating charge, and a shatterable sealing sheet 8 mounted on said pressure releasing hole 9, wherein said propping agent unit 7 comprises a propping agent box 70, a center through-hole 71 located at the center of said propping agent box 70, and propping agent 72 in said propping agent box 70.

12 Claims, 3 Drawing Sheets

(56) References Cited

U.S. PATENT DOCUMENTS

| | | | | |
|---|---|---|---|---|
| 4,191,265 | A | 3/1980 | Bosse-Platiere | |
| 4,253,523 | A | 3/1981 | Ibsen | |
| 4,627,353 | A | 12/1986 | Chawla | |
| 4,633,951 | A | 1/1987 | Hill et al. | |
| 4,683,943 | A | 8/1987 | Hill et al. | |
| 4,760,883 | A | 8/1988 | Dunn | |
| 4,823,875 | A | 4/1989 | Hill | |
| 4,976,318 | A | 12/1990 | Mohaupt | |
| 5,355,802 | A | 10/1994 | Petitjean | |
| 5,775,426 | A | 7/1998 | Snider et al. | |
| 5,885,321 | A | 3/1999 | Higa et al. | |
| 6,082,450 | A | 7/2000 | Snider et al. | |
| 6,186,230 | B1 | 2/2001 | Nierode | |
| 6,439,121 | B1 | 8/2002 | Gillingham | |
| 6,497,285 | B2 | 12/2002 | Walker | |
| 6,837,310 | B2 | 1/2005 | Martin | |
| 6,851,471 | B2 | 2/2005 | Barlow et al. | |
| 7,216,708 | B1 | 5/2007 | Bond et al. | |
| 7,430,965 | B2 | 10/2008 | Walker | |
| 7,913,761 | B2 | 3/2011 | Pratt et al. | |
| 2002/0134585 | A1 | 9/2002 | Walker | |
| 2002/0189802 | A1 | 12/2002 | Tolman et al. | |
| 2003/0037692 | A1 | 2/2003 | Liu | |
| 2003/0150646 | A1 | 8/2003 | Brooks et al. | |
| 2004/0129415 | A1 | 7/2004 | Zhang et al. | |
| 2004/0216866 | A1 | 11/2004 | Barlow et al. | |
| 2005/0115441 | A1 | 6/2005 | Mauldin | |
| 2005/0139352 | A1 | 6/2005 | Mauldin | |
| 2006/0118303 | A1 | 6/2006 | Schultz et al. | |
| 2008/0230225 | A1* | 9/2008 | Meddes et al. | 166/297 |
| 2009/0078420 | A1 | 3/2009 | Caminari et al. | |
| 2009/0183916 | A1 | 7/2009 | Pratt et al. | |
| 2010/0243323 | A1* | 9/2010 | McCann et al. | 175/2 |
| 2010/0252263 | A1* | 10/2010 | Ferrero et al. | 166/280.2 |
| 2010/0258292 | A1 | 10/2010 | Tiernan et al. | |
| 2010/0276136 | A1 | 11/2010 | Evans et al. | |
| 2011/0240311 | A1 | 10/2011 | Robison et al. | |
| 2013/0098681 | A1 | 4/2013 | Zhang et al. | |
| 2013/0145924 | A1 | 6/2013 | Zhang et al. | |
| 2013/0146287 | A1 | 6/2013 | Zhang et al. | |
| 2013/0206385 | A1 | 8/2013 | Feng et al. | |

FOREIGN PATENT DOCUMENTS

| | | | |
|---|---|---|---|
| CN | 2314091 | | 4/1999 |
| CN | 2348095 | | 11/1999 |
| CN | 2376535 | | 5/2000 |
| CN | 2386194 | | 7/2000 |
| CN | 2391987 | | 8/2000 |
| CN | 2437852 | | 7/2001 |
| CN | 1312882 | | 9/2001 |
| CN | 2453132 | | 10/2001 |
| CN | 2485421 | | 4/2002 |
| CN | 2555393 | | 6/2003 |
| CN | 1143944 | | 3/2004 |
| CN | 2611593 | | 4/2004 |
| CN | 2628724 | | 7/2004 |
| CN | 2630491 | | 8/2004 |
| CN | 2630493 | | 8/2004 |
| CN | 2653125 | | 11/2004 |
| CN | 2682199 | | 3/2005 |
| CN | 2695631 | | 4/2005 |
| CN | 2818773 | | 9/2006 |
| CN | 2818774 | | 9/2006 |
| CN | 2821154 | | 9/2006 |
| CN | 2821154 | Y | 9/2006 |
| CN | 2846740 | | 12/2006 |
| CN | 2854071 | | 1/2007 |
| CN | 1916357 | | 2/2007 |
| CN | 2866810 | | 2/2007 |
| CN | 200968200 | | 10/2007 |
| CN | 201045293 | | 4/2008 |
| CN | 100491692 | | 5/2009 |
| CN | 201358768 | | 12/2009 |
| CN | 201396090 | | 2/2010 |
| CN | 201412133 | | 2/2010 |
| CN | 201531256 | | 7/2010 |
| CN | 201568033 | | 9/2010 |
| CN | 201568038 | | 9/2010 |
| CN | 201620848 | | 11/2010 |
| CN | 101952542 | | 1/2011 |
| CN | 102031952 | | 4/2011 |
| CN | 201843593 | | 5/2011 |
| CN | 102094613 | | 6/2011 |
| CN | 201865649 | | 6/2011 |
| CN | 201884014 | | 6/2011 |
| CN | 201934084 | | 8/2011 |
| CN | 201934084 | U | 8/2011 |
| CN | 201934086 | | 8/2011 |
| CN | 201991504 | | 9/2011 |
| CN | 202055812 | | 11/2011 |
| CN | 102410006 | | 4/2012 |
| CN | 102518419 | | 6/2012 |
| CN | 1690357 | | 7/2012 |
| CN | 202391399 | | 8/2012 |
| CN | 102011561 | | 4/2013 |
| CN | 102052068 | | 4/2013 |
| CN | 102022101 | | 7/2013 |
| WO | 02/063133 | | 8/2002 |
| WO | 2011057564 | | 5/2011 |
| WO | 2011057564 | A1 | 5/2011 |
| WO | 2012088985 | | 5/2011 |
| WO | 2012088984 | | 7/2012 |
| WO | 2013090647 | | 6/2013 |
| WO | 2013123268 | | 8/2013 |
| WO | 2013130166 | | 9/2013 |

OTHER PUBLICATIONS

Mar. 5, 2012 Office Action for CN 200910218911.0.
Jul. 6, 2013 2nd Office Action for CN 201010609790.5.
Jul. 11, 2013 1st Office Action for CN 201110426049.X.
Feb. 10, 2011 International Search Report for PCT/CN2010/078601.
Mar. 15, 2012 International Search Report for PCT/CN2011/083112.
Mar. 8, 2013 International Search Report for PCT/CN2011/083113.
Aug. 6, 2013 International Search Report for PCT/US2012/069606.
Feb. 28, 2013 International Search Report for PCT/US2012/069607.
Feb. 10, 2011 Written Opinion for PCT/CN2010/078601.
Mar. 15, 2012 Written Opinion for PCT/CN2011/083112.
Mar. 8, 2013 Written Opinion for PCT/CN2011/083113.
Aug. 6, 2013 Written Opinion for PCT/US2012/069606.
Feb. 28, 2013 Written Opinion for PCT/US2012/069607.
Zhang, 2009, "Mechanism Difference and Safety Analysis of Different Composite Perforators Types", Testing of Oil and Gas Wells, vol. 18(4), pp. 59-61.
Zhao, 2007, "Efficiency Monitoring, Comparison Analysis and Optimization of Composite Perforators", Well logging technology, vol. 31(1), p. 66-71.
Zhang et al., 1986, "Preliminary studies on high energy gas fracture", Journal of Xi'an Petroleum Institute, vol. 1 (2).
Liu et al., 2006, "Investigation on a composite perforator with in-built secondary synergistic effect", Conference paper of the fifth annual conference of the perforating branch of the Professional Committee of well testing in the Chinese Petroleum Society.
Yao et al., 2006, "Experimental investigation on the effect of a sleeve like gunpowder on the penetration depth of composite perforator", Conference on new developments in perforation technology by the perforating branch of the Professional Committee of well logging in the Chinese Petroleum Society.
Feng et al., 1996, "Analysis of the characteristics of two gunpowder charges in multi-pulse composite perforator and the process of fracturing", Explosive Materials, vol. 75 (4), 130-133.
Zhao et al., 2005, "On powder Burning Characteristics of Various Perforators", Well logging technology, vol. 30 (1) , 44-46.
Wang et al., 2002, "The current status and trends in combined perforating-fracturing techniques", Explosive materials, vol. 31 (3), 30-34.
Sun et al., 2007 "Review of combined perforating techniques", Explosive materials, vol. 36 (5).

(56) References Cited

OTHER PUBLICATIONS

Feng et al., 2005, "Investigation on multi-pulse perforation techniques", Explosive materials, vol. 34 (1), 32-36.
Zhu, 1993, "Developments of perforators outside China", Explosive Materials, vol. 75(4).
Nov. 22, 2012 Office Action for CN 201010809790.5.
Sep. 27, 2012 Office Action for CN 200910218911.0.
Apr. 16, 2014 Office Action for U.S. Appl. No. 13/814,243.
Jul. 8, 2014 Office Action for U.S. Appl. No. 13/814,243.
Jul. 16, 2014 Restriction Requirement for U.S. Appl. No. 13/759,064.
Jun. 25, 2014 Office Action for U.S. Appl. No. 13/814,242.

* cited by examiner

COMPOSITE PERFORATION METHOD AND DEVICE WITH PROPPING AGENT

This application is a Continuation-in-part of International Application PCT/CN2011/083113 filed Nov. 29, 2011, which claims priority of Chinese Application 201010609790.5, filed Dec. 29, 2010. The entire content of these applications are incorporated by reference into this application.

FIELD OF THE INVENTION

The present invention relates to the field of oil exploration and exploitation, and particularly relates to a composite perforation method and device with propping agent.

BACKGROUND OF THE INVENTION

In the field of exploration and exploitation of oil and gas wells, composite perforation technology is widely used in the well completion process of oil reservoirs that have low permeability, super-low permeability, or are difficult to draw on so that it can act as an effective means to increase productivity by perforation and fracturing. Composite perforation is a technology developed on the basis of shaped-charge perforation. As a perforation tunnel is formed by the shaped charge perforation, the gunpowder charged into the perforator is triggered to burn and form dynamic gases of high temperature and high pressure in the gun. The high temperature and high pressure gases enter the perforation tunnel through the perforation hole and pressure releasing holes on the gun body to perform effective gas fracturing to the stratum such that a network of deeply penetrating fissures of the combined pore-fracture type is formed near the wellbore. The purpose for this is to increase the oil conductivity of the stratum near the wellbore, reduce the resistance to the oil flow, and increase the productivity of the oil and gas well. The effect of composite perforation to substantially increase productivity is widely acknowledged in the art. However, an inadequate aspect of composite perforation is that although initially the effect of increased productivity is prominent after the perforation fracturing, there is a tendency for this capacity to progressively decrease with the duration of the oil extraction. Research have shown that the fracture networks near the wellbore formed by the composite perforations will partially close over time, shortening the part of the oil extraction cycle with high productivity, which in turn compromises the effect of the composite perforation. Thus, there is a need to improve the process.

SUMMARY OF INVENTION

The present invention aims to provide a composite perforation method and device with propping agent capable of effectively propping the fractures in the oil layer, reducing the closure of fractures and prolonging the oil extraction cycle.

In one embodiment, a solution to the above problem is to deliver a propping agent into the fractures during fracturing to effectively prop the fractures, so as to stabilize the production.

To solve the above problem, this invention provides a composite perforation method involving a propping agent. In one embodiment, a propping agent unit containing propping agents is provided at the open end of the perforating charges in a perforator. During composite perforation, the perforator is delivered to the desired location in the oil and gas well before the perforating charges detonate. A perforation tunnel is formed between the wellbore and stratum due to the high-speed jet flow generated by the detonation of the perforating charges while the negative pressure arising from the jet flow carries the propping agent into the perforation tunnel. When the gunpowder for fracturing is triggered in the perforator, the secondary energy generated will fracture the perforation tunnel and produces fractures near the wellbore; the propping agent will be carried into the extended fractures during this process to prop the fractures.

In another embodiment, a further improvement in the present invention is that the propping agent unit also contains propellants. When the perforation tunnel is formed between the wellbore and the stratum by the high-speed jet flow generated after the detonation of the perforating charges, the propellant in the propping agent unit is triggered such that the propping agents are carried into the perforation tunnel by the negative pressure arising from the jet flow and a thrust generated by the propellant.

In one embodiment, the composite perforation device with propping agent in the present invention comprises one composite perforator or a plurality of connected perforators. A plurality of pressure releasing holes are provided on the composite perforator at the locations facing the jet flow of perforating charges. Shatterable sealing sheets are mounted on the pressure releasing holes, and a propping agent unit is provided at the open end of the perforating charges in the perforator. In one embodiment, the propping agent unit comprises a propping agent box having a through-hole at the center containing propping agent in it. In one embodiment, concaved grooves are preferred on the left and right side of the propping agent box along the circumferential direction for easy attachment to the charge frame.

In another embodiment, the propping agent box further contains propellant so that excitation of the propellant in the propping agent box after detonation of the perforating charges can generate high energy gases so that the propping agent is carried into the perforation tunnel under both the negative pressure arising from the jet flow and the thrust generated by the propellant. The propellant not only increases the amount of propping agent carried into the perforation tunnel, but also increases the kinetic energy of the propping agent.

In one embodiment, the propping agent is positioned at the inner side of the inner cavity of the propping agent box while the propellant is positioned at the outer side of the inner cavity of the propping agent box.

In one embodiment, the above propping agent can be fracturing sand, carborundum, ceramcite, steel grit, steel ball, or stainless steel ball, with a diameter of 0.1~1 mm (e.g. screen mesh: 140~20).

The through-hole at the center of the propping agent box is the channel through which the jet generated by the detonation of perforating charges passes through. The diameter of the through-hole is designed based on the principle that the indices of jet penetration shall not be affected. In one embodiment, the diameter of the through-hole is larger than the diameter of the jet while it is smaller than the diameter of the pressure releasing hole.

In one embodiment, the propping agent box is made of non-metallic materials such as high strength polyethylene of high heat resistance (e.g. a cross-linking agent is mixed with the polyethylene to enhance the strength of the connection between the molecular chains), polytetrafluoroethylene and polypropylene, capable of withstanding temperature in the range of about 121° C. to 250° C.

In one embodiment, the shatterable sealing sheets mounted on the pressure releasing hole are made of brittle materials and will be shattered into pieces after detonation so as to prevent plugging of the composite perforator due to fall out of the sealing sheets when conventional steel sealing sheets are used.

In one embodiment, the present invention positioned the propping agent at the open end of the perforating charge so as to facilitate smooth entry of propping agent into the perforation tunnel. This invention is simple to assemble, easy to pack and transport, while, at the same time, convenient for large-scale and standardized production. It was experimentally proven that the present invention can effectively prop fractures to prolong the oil extraction cycle, and achieve sustained production.

LEGEND OF THE FIGURES

Figure 1:
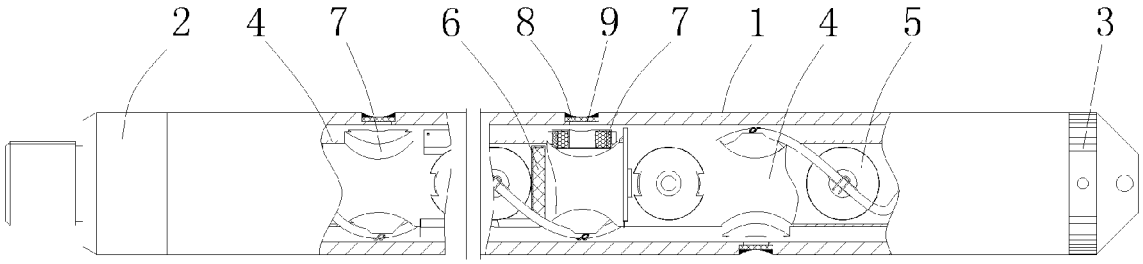
FIG. 1 shows the structure of the composite perforation device with propping agent in one embodiment of the present invention.

1: gun body; 2: connector; 3: plug; 4: charge frame; 5: perforating charge; 6: gunpowder for fracturing; 7: propping agent unit; 8: shatterable sealing sheet; 9: pressure releasing hole; 41: protrusion; 70: propping agent box; 71: center through-hole; 72: propping agent; 73: propellant; 74: top surface; 75: groove

DETAILED DESCRIPTION OF THE INVENTION

In one embodiment, this invention provides a composite perforation method for oil and gas wells, comprising the steps of:

conveying a composite perforator to a set point of an oil and gas well, wherein said perforator comprises one or more perforating charges and a propping agent box located at the open end of each of said perforating charge; said propping agent box contains propping agent;

detonating the perforating charge to generate a high-speed jet flow, said high-speed jet flow forming a perforation tunnel between the wellbore and the stratum and simultaneously carrying the propping agent into said perforation tunnel; and detonating fracturing gunpowder in the perforator to perform fracturing in said perforation tunnel to generate fractures near the wellbore and carry the propping agent into said fractures.

In one embodiment, said propping agent box further contains a propellant.

In another embodiment, said propellant generates a thrust to increase the amount of propping agent carried into the perforation tunnel In one embodiment, this invention further provides a composite perforation device comprising one or more connected perforators wherein each of said perforator comprises one or more perforating charges and a propping agent unit 7 at the open end of each of said perforating charge, a pressure release hole 9 located directly behind the jet flow of said perforating charge, and a shatterable sealing sheet 8 mounted on said pressure releasing hole 9, wherein said propping agent unit 7 comprises a propping agent box 70, a center through-hole 71 located at the center of said propping agent box 70, and propping agent 72 in said propping agent box 70.

In one embodiment, said propping agent box 70 further comprises concaved grooves 75 located on both left and right side of said propping agent box (70) along the circumferential direction, wherein said concaved grooves 75 can lock said propping agent box 70 onto the charge frame 4.

In one embodiment, said propping agent box 70 further contains a propellant 73. In one embodiment, said propping agent 72 is positioned at the inner side of the inner cavity of the propping agent box 7 while the propellant is positioned at the outer side of the inner cavity of the propping agent box.

In one embodiment, said propping agent box 70 is made of high-temperature resistant non-metallic materials.

In another embodiment, said non-metallic materials are temperature resistant in the range of about 121° C.~250° C.

In yet another embodiment, said non-metallic material is high-strength polyethylene, polytetrafluoroethylene, or polypropylene.

In one embodiment, the diameter of said pressure releasing hole 9 is larger than the diameter of said center through-hole 71.

In one embodiment, said propping agent is one of fracturing sand, corundum, haycite, steel grit, steel ball, or stainless steel ball.

In another embodiment, the diameter of said propping agent is from about 0.1 to 1 mm.

In one embodiment, this invention further provides a composite perforation method for oil and gas wells, comprising the steps of:

conveying a composite perforator to a set point of an oil and gas well, wherein said perforator comprises a propping agent unit 7 at the open end of a perforating charge comprising a propping agent box 70, a center through-hole 71 located at the center of said propping agent box 70, and propping agent 72 in said propping agent box 70;

detonating the perforating charge to generate a high-speed jet flow, said high-speed jet flow forming a perforation tunnel between the wellbore and the stratum and simultaneously carrying the propping agent into said perforation tunnel; and detonating fracturing gunpowder in the perforator to perform fracturing in said perforation tunnel to generate fractures near the wellbore and carry the propping agent into said fractures.

In one embodiment, the diameter of said center through-hole 71 is larger than the diameter of said high-speed jet flow.

The examples will be illustrated with reference to the drawings below:

In one embodiment, as illustrated in FIG. 1, a connector 2 and a plug 3 are provided on the left and right ends of a perforator gun body 1 respectively. A plurality of perforating charges 5 are mounted on the charge frame 4, with each perforating charge 5 arranged spirally with a 90° phase in between and a density of 16 holes per meter. Between every two adjacent perforating charges 5 is the gunpowder 6 for fracturing, and a propping agent unit 7 is mounted at the open end of the perforating charge 5. Multiple pressure releasing holes 9 are provided on the composite perforator and each corresponds to the jet direction of a perforating charge 5. Shatterable sealing sheet 8 is mounted on the pressure releasing hole.

Figure 2:
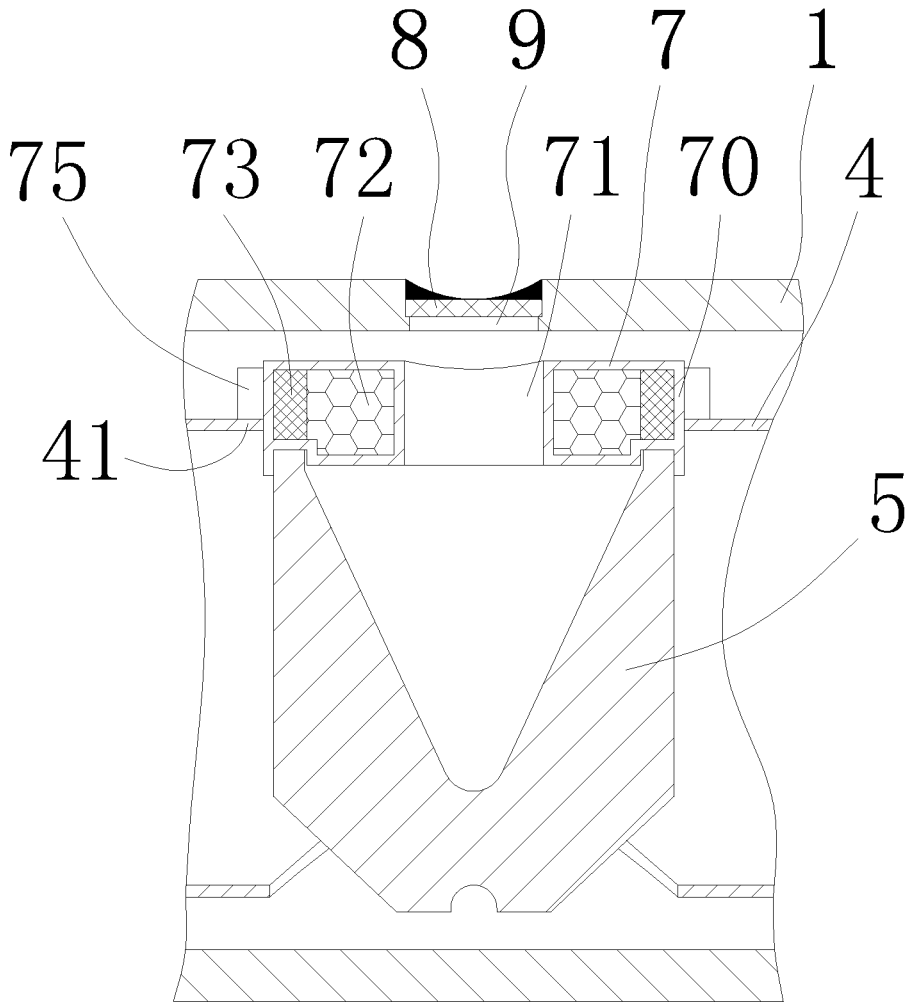
FIG. 2 shows the part of the perforator in FIG. 1 where a propping agent unit and a perforating charge is mounted.
Figure 3:
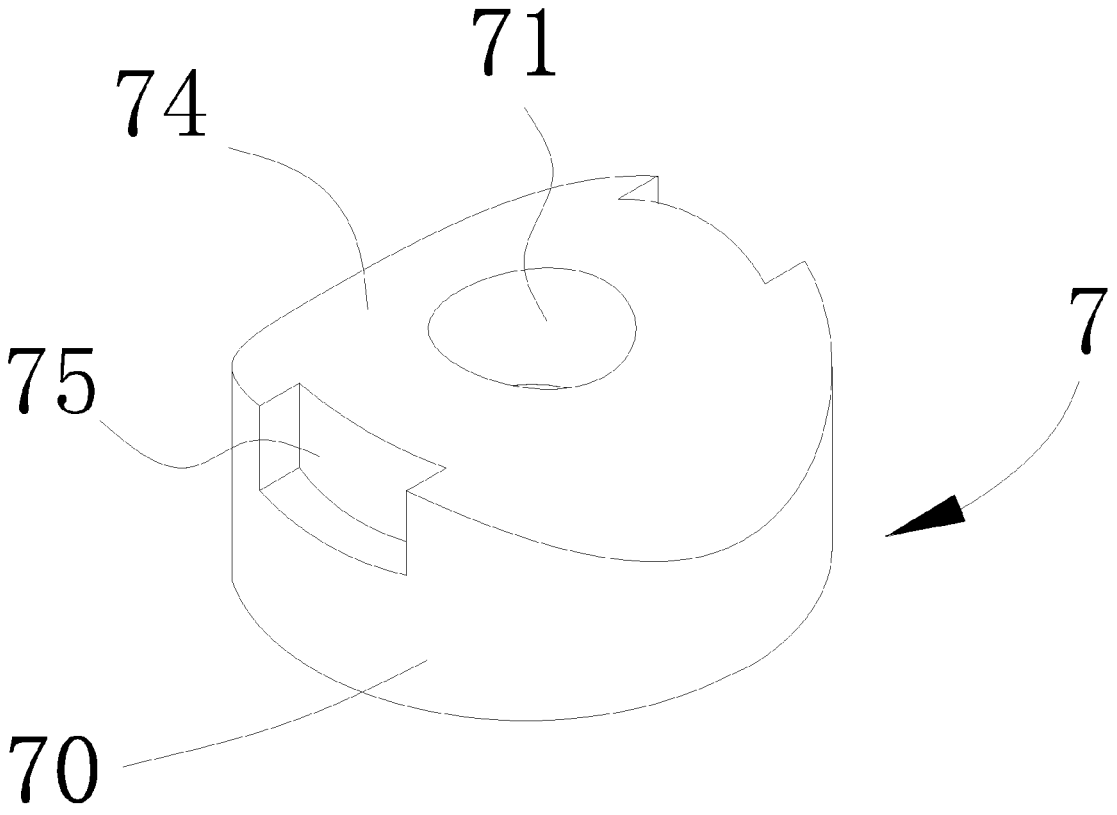
FIG. 3 shows the perspective view of the propping agent unit of the present invention.

In one embodiment, as illustrated in FIGS. 2 and 3, the propping agent unit 7 in the composite perforator comprises a propping agent box 70 having a center through-hole 71 with a diameter of 12 mm. The propping agent unit 7 has an annular inner cavity. The inner cavity of the propping agent box contains propping agent 72 and propellant 73. Standard propellant used in conventional composite perforators can be chosen as the propellant 73. The propellant in this example composed of 75%~80% ammonium perchlorate and 20%~25% polyether (by weight). In one embodiment, the propping agent 72 is fracturing sand of diameter 0.6 mm (i.e. screen mesh: 30). During mounting, the propellant is first arranged on the outer side of the inner cavity of the propping agent unit before the propping agent is infused.

In one embodiment, the propping agent box is made of polyethylene capable of withstanding temperature up to 163° C. The top surface 74 of the propping agent box 70 is a convex cambered surface. Concaved grooves 75 are on the left and right side of the propping agent box 70 along the circumferential direction for locking with protrusions 41 on the charge frame 4 that is adjacent to the perforating charges 5 so as to attach the propping agent unit 7 to the charge frame 4. The propping agent unit 7 after mounting is locked into position by the grooves on its two sides and the protrusions 41 on the charge frame 4 while the bottom end of the propping agent unit 7 is pressed against by the front end of the perforating charge.

What is claimed is:

1. A composite perforation device comprising one or more connected perforators, each of said perforators comprises:

i. a gun body (1);

ii. one or more perforating charges (5) within said gun body (1), wherein each of said perforating charges (5) comprises an open-end and a closed-end, wherein a high speed jet flow is created and forced through said open-end when each of said perforating charges (5) is detonated;

iii. gunpowder for fracturing (6) located between each adjacent perforating charge (5);

iv. a propping agent unit (7) at the open end of each of said perforating charges (5), wherein each of said propping agent unit (7) comprises a propping agent box (70) having a center through-hole (71), said center through-hole (71) is surrounded by a propping agent (72) contained in said propping agent box (70);

v. a plurality of pressure release holes (9) on said gun body (1), wherein each of said pressure release holes (9) faces the open end of each of said perforating charges (5), wherein each of said pressure release hole (9) have a diameter larger than that of a corresponding center through-hole (71); and vi. a shatterable sealing sheet (8) mounted on each of said pressure release holes (9).

2. The composite perforation device of claim 1, wherein each said propping agent box (70) further comprises concaved grooves (75) located on both left and right side of each said propping agent box (70), wherein said concaved grooves (75) lock each said propping agent box (70) onto a charge frame (4).

3. The composite perforation device of claim 1, wherein each said propping agent box (70) further contains a propellant (73).

4. The composite perforation device of claim 1, wherein each said propping agent box (70) comprises an inner cavity and an outer cavity, wherein said propping agent (72) is positioned at said inner cavity and said propellant (73) is positioned at said outer cavity.

5. The composite perforation device of claim 1, wherein each said propping agent box (70) is made of high-temperature resistant non-metallic materials.

6. The composite perforation device of claim 5, wherein said non-metallic materials are temperature resistant in the range of about 121° C.~250° C.

7. The composite perforation device of claim 5, wherein said non-metallic material are high-strength polyethylene, polytetrafluoroethylene, or polypropylene.

8. The composite perforation device of claim 1, wherein said propping agent (72) is one of fracturing sand, corundum, haycite, steel grit, steel ball, or stainless steel ball.

9. The composite perforation device of claim 1, wherein said propping agent (72) has a diameter from 0.1 to 1 mm.

10. A method of using the composite perforation device of claim 1, comprising the steps of:

conveying said composite perforation device to a desired location;

detonating the perforating charges (5) so that each of said perforating charges (5) generates a high-speed jet flow for perforation and simultaneously carries the propping agent (72) out of each said propping agent box (70); and detonating said gunpowder for fracturing (6) thereby sending the propping agent (72) to where propping is needed.

11. The method of claim 10, wherein each said propping agent box (70) further contains a propellant (73).

12. The method of claim 11, wherein said propellant (73) generates a thrust to increase the amount of propping agent (72) being carried by said high speed jet.

* * * * *